US009395085B2

(12) United States Patent
Budmir et al.

(10) Patent No.: US 9,395,085 B2
(45) Date of Patent: Jul. 19, 2016

(54) COMMUNICATING STRUCTURE BETWEEN ADJACENT COMBUSTORS AND TURBINE PORTION AND GAS TURBINE

(75) Inventors: Rosic Budmir, Cambridge (GB); Yasuro Sakamoto, Tokyo (JP); Sumiu Uchida, Tokyo (JP); Eisaku Ito, Tokyo (JP); Tsuyoshi Kitamura, Tokyo (JP); Satoshi Hada, Tokyo (JP); Sosuke Nakamura, Tokyo (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 891 days.

(21) Appl. No.: 13/500,009

(22) PCT Filed: May 14, 2010

(86) PCT No.: PCT/JP2010/058171

§ 371 (c)(1),
(2), (4) Date: Jun. 15, 2012

(87) PCT Pub. No.: WO2011/070806

PCT Pub. Date: Jun. 16, 2011

(65) Prior Publication Data

US 2012/0247125 A1 Oct. 4, 2012

(30) Foreign Application Priority Data

Dec. 7, 2009 (JP) ..... 2009-277746

(51) Int. Cl.
*F01D 9/02* (2006.01)
*F23R 3/60* (2006.01)
(Continued)

(52) U.S. Cl.
CPC . *F23R 3/60* (2013.01); *F01D 9/023* (2013.01); *F01D 9/065* (2013.01); *F23R 3/346* (2013.01)

(58) Field of Classification Search
CPC ..... F23R 3/60; F23R 3/346; F01D 9/065; F01D 9/023
USPC ..... 60/39.37, 752, 800
See application file for complete search history.

(56) References Cited

U.S. PATENT DOCUMENTS 2,743,579 A * 5/1956 Gaubatz ..... 60/804
3,018,624 A * 1/1962 Massey et al. ..... 60/39.37
(Continued)

FOREIGN PATENT DOCUMENTS

CA 2633787 A1 12/2008
CN 85 1 05 913 A 8/1986
(Continued)

OTHER PUBLICATIONS

Office Action dated Dec. 4, 2013, issued in corresponding Chinese application No. 201080044670.3, w/ English translation (17 pages).
(Continued)

*Primary Examiner* — William H Rodriguez
*Assistant Examiner* — Eric Linderman
(74) *Attorney, Agent, or Firm* — Westerman, Hattori, Daniels & Adrian, LLP

(57) ABSTRACT

In a communicating structure between combustors that generates combustion gas inside pipe pieces and a turbine portion that generates a rotational driving force by making the combustion gas sequentially pass through a turbine stage formed of turbine stator vanes and turbine rotor blades, at least some of the first-stage turbine stator vanes closest to the combustor among the turbine stator vanes are disposed downstream of sidewalls of one pipe piece and another pipe piece that are adjacent to each other, and the distance from leading edges of the first-stage turbine stator vanes disposed downstream of the sidewalls of the pipe pieces to end portions of the sidewalls closer to the turbine portion is equal to or less than a spacing between an internal surface of the sidewall of the one pipe piece and an internal surface of the sidewall of the other pipe piece.

6 Claims, 9 Drawing Sheets

(51) Int. Cl.
*F01D 9/06* (2006.01)
*F23R 3/34* (2006.01)

(56) References Cited

U.S. PATENT DOCUMENTS

| | | | | | |
|---|---|---|---|---|---|
| 3,746,462 | A * | 7/1973 | Fukuda | 415/115 | |
| 4,852,355 | A * | 8/1989 | Kenworthy et al. | 60/751 | |
| 5,458,461 | A * | 10/1995 | Lee et al. | 416/97 R | |
| 6,036,438 | A * | 3/2000 | Imai | 415/192 | |
| 6,554,562 | B2 * | 4/2003 | Dudebout et al. | 415/1 | |
| 7,836,703 | B2 * | 11/2010 | Lee et al. | 60/806 | |
| 7,886,991 | B2 * | 2/2011 | Zuo et al. | 239/13 | |
| 7,930,891 | B1 * | 4/2011 | Brostmeyer | F01D 9/023 415/209.2 | |
| 8,065,881 | B2 * | 11/2011 | Charron et al. | 60/752 | |
| 9,091,170 | B2 * | 7/2015 | Sakamoto et al. | | |
| 9,267,691 | B2 * | 2/2016 | Davi | F23R 3/60 | |
| 2002/0184889 | A1 * | 12/2002 | Calvez et al. | 60/796 | |
| 2003/0165384 | A1 * | 9/2003 | Jonsson | 415/209.3 | |
| 2004/0060298 | A1 * | 4/2004 | Han | F01D 9/02 60/772 | |
| 2005/0079060 | A1 | 4/2005 | MacManus | | |
| 2005/0089394 | A1 | 4/2005 | Lu et al. | | |
| 2006/0272314 | A1 * | 12/2006 | Moniz et al. | 60/226.1 | |
| 2007/0017225 | A1 * | 1/2007 | Bancalari et al. | 60/752 | |
| 2007/0140849 | A1 * | 6/2007 | Flodman et al. | 416/97 R | |
| 2009/0084082 | A1 * | 4/2009 | Martin et al. | 60/39.281 | |
| 2010/0071382 | A1 * | 3/2010 | Liang | 60/806 | |
| 2010/0115953 | A1 * | 5/2010 | Davis et al. | 60/737 | |
| 2010/0122538 | A1 * | 5/2010 | Ning et al. | 60/806 | |
| 2010/0232954 | A1 * | 9/2010 | Clemen | 415/199.4 | |
| 2010/0313567 | A1 * | 12/2010 | Nakamura et al. | 60/722 | |
| 2011/0209482 | A1 * | 9/2011 | Toqan et al. | 60/804 | |
| 2011/0247314 | A1 * | 10/2011 | Chila et al. | 60/39.281 | |

FOREIGN PATENT DOCUMENTS

| | | | | | |
|---|---|---|---|---|---|
| EP | 1 522 679 | A2 | | 4/2005 | |
| GB | 980363 | A | | 1/1965 | |
| JP | 61-6606 | U | | 1/1986 | |
| JP | 62-121835 | A | | 6/1987 | |
| JP | 06-017652 | B2 | | 3/1994 | |
| JP | 2001-289003 | A | | 10/2001 | |
| JP | 2004-116992 | A | | 4/2004 | |
| JP | 2005-083292 | A | | 3/2005 | |
| JP | 2005-120871 | A | | 5/2005 | |
| JP | 2005120871 | A | * | 5/2005 | |
| JP | 2006-52910 | A | | 2/2006 | |
| JP | 2006-105076 | A | | 4/2006 | |
| JP | 2009-197650 | A | | 9/2009 | |
| JP | 2009197650 | A | * | 9/2009 | |
| JP | EP 2369137 | A1 | * | 9/2011 | F01D 5/186 |
| WO | 2009/104317 | A1 | | 8/2009 | |

OTHER PUBLICATIONS

Office Action dated Dec. 27, 2013, issued in corresponding Korean application No. 10-2012-7008290 (2 pages).
Notice of Allowance dated Jan. 14, 2014, issued in corresponding Japanese application No. 2009-277746 (3 pages).
International Search Report of PCT/JP2010/058171, mailing date of Aug. 24, 2010.
International Search Report of PCT/JP2009/007173, mailing date Mar. 16, 2010.
European Search Report dated May 4, 2012, issued in corresponding European Patent Application No. 09834463.3, 6 pages.
Office Action issued Mar. 22, 2013, issued in corresponding Chinese Patent Application No. 200980127062.6; w/ English translation (15 pages).
Non-Final Office Action dated Oct. 7, 2013, issued in related U.S. Appl. No. 13/000,874.
Final Office Action dated Nov. 24, 2014, issued in related U.S. Appl. No. 13/000,874 (14 pages).
Decision to Grant a Patent dated Apr. 29, 2014, issued in Corresponding Korean Patent Application No. 10-2013-7019998, (2 pages).
Chinese Notice of Allowance dated Nov. 4, 2014, issued in corresponding Chinese Patent Application No. 201080044670.3 (2 pages).
U.S. Office Action dated Nov. 24, 2014, issued in U.S. Appl. No. 13/000,874 (14 pages).
Decision to Grant a Patent dated Dec. 27, 2013, issued in corresponding Korean application No. 10-2012-7008290 (2 pages).
Written Opinion dated Mar. 16, 2010, issued in related application No. PCT/JP2009/007173 (1 page).
European Office Action dated Feb. 11, 2015, issued in corresponding EP Patent Application No. 09834463.3 (5 pages).
Notice of Allowance dated Mar. 24, 2015, issued in corresponding U.S. Appl. No. 13/000,874 (7 pages).

* cited by examiner

COMMUNICATING STRUCTURE BETWEEN ADJACENT COMBUSTORS AND TURBINE PORTION AND GAS TURBINE

TECHNICAL FIELD

The present invention relates to a communicating structure between a combustor and a turbine portion and to a gas turbine.

BACKGROUND ART

A gas turbine generally includes a compressor, a combustor, and a turbine portion as main components; the compressor is coupled to a turbine with a rotating shaft; and the combustor is disposed between the compressor and the turbine portion.

In the above-described gas turbine, air, which is working fluid, is taken into the compressor, which is rotationally driven by the rotating shaft, to be compressed therein, and the compressed air is introduced into the combustor. Fuel is mixed with the compressed gas in the combustor, and high-temperature, high-pressure combustion gas is generated by combustion of the mixed air. The combustion gas is expelled to the turbine portion from the combustor to rotationally drive the turbine portion.

Specifically, the high-temperature working fluid expelled from the combustor, which includes the combustion gas, passes through between first-stage turbine stator vanes in the turbine portion and subsequently flows to first-stage turbine rotor blades. At the first-stage turbine rotor blades, part of the energy possessed by the working fluid is converted to rotational energy and is transmitted to the rotating shaft as a rotational driving force.

Normally, a rear end of a tail pipe of the combustor and leading edges of the first-stage turbine stator vanes positioned most upstream of the turbine portion are disposed with gaps therebetween. Accordingly, there is a problem in that part of the high-temperature working fluid that flows toward the turbine portion from the combustor flows into the gaps between the rear end of the tail pipe and the leading edges of the first-stage turbine stator vanes, and a loss occurs caused by this flow.

In addition, there is a problem in that the leading edges of the first-stage turbine stator vanes are heated by the high-temperature working fluid that has flowed into the gaps, and thus, a large amount of cooling fluid is required.

As a technique for solving the above-described problems, a method in which the first-stage turbine stator vanes are brought close to the combustor has been proposed (for example, see Patent Literature 1).

With the technique disclosed in Patent Literature 1, the leading edges of the first-stage turbine stator vanes are surrounded by the rear end of the combustor, and cooling fluid for cooling the first-stage turbine stator vanes is supplied from the tail pipe via slits formed at the leading edges. By doing so, the high-temperature working fluid does not collide with the leading edges of the first-stage turbine stator vanes, and the cooling fluid that was previously employed to cool the leading edges is not required.

CITATION LIST

Patent Literature

{PTL 1} Japanese Unexamined Utility Model Application, Publication No. Sho 61-6606.

SUMMARY OF INVENTION

Technical Problem

However, with the above-described technique disclosed in Patent Literature 1, although integration of the combustor and the first-stage turbine stator vanes is described, there is no disclosure about the shape of an inner wall of the combustor inside which the high-temperature working fluid flows.

Because of this, the flow of the high-temperature working fluid that flows along the inner wall of the combustor is sometimes disturbed at a connecting portion between the inner wall and the first-stage turbine stator vanes. There is a problem in that this disturbance in the flow of the working fluid may affect the efficiency of the gas turbine.

On the other hand, when the flow of the working fluid is disturbed at the connecting portion between the inner wall and the first-stage turbine stator vanes as described above, the flow of working fluid in the peripheries of the first-stage turbine stator vanes is disturbed. Accordingly, there is a problem in that it is difficult to supply cooling fluid from between the combustor and the first-stage turbine stator vanes and to form a film-like layer of cooling fluid at the surfaces of the first-stage turbine stator vanes, which makes cooling of the first-stage turbine stator vanes difficult.

The present invention has been conceived in order to solve the above-described problems, and an object thereof is to provide a communicating structure between a combustor and a turbine portion and a gas turbine that are capable of suppressing the occurrence of a loss and also capable of reducing the flow level of cooling fluid employed in cooling turbine blades.

Solution To Problem

In order to achieve the above-described object, the present invention provides the following solutions.

A communicating structure between combustors and a turbine portion according to a first aspect of the present invention is a communicating structure between combustors that generate combustion gas by combusting compressed air supplied from a compressor and fuel supplied from fuel nozzles, which are mixed inside a plurality of pipe pieces disposed next to each other around a rotating shaft, and a turbine portion that generates a rotational driving force by making the combustion gas sequentially pass through a turbine stage formed of a plurality of turbine stator vanes and turbine rotor blades disposed around the rotating shaft, wherein at least some of first-stage turbine stator vanes closest to the combustors among the turbine stator vanes are disposed downstream of sidewalls of one pipe piece and another pipe piece that are adjacent to each other, and the distance from leading edges of the first-stage turbine stator vanes disposed downstream of the sidewalls to end portions of the sidewalls closer to the turbine portion is equal to or less than a spacing between an internal surface of the sidewall of the one pipe piece and an internal surface of the sidewall of the other pipe piece.

With the communicating structure between the combustors and the turbine portion according to the first aspect of the present invention, by disposing the first-stage turbine stator vanes positioned downstream of the sidewalls close to the end portions of the sidewalls closer to the turbine portion, the combustion gas is prevented from flowing in between the sidewalls and the first-stage turbine stator vanes. Accordingly, the occurrence of a loss due to the inflow of the combustion gas between the sidewalls and the first-stage turbine stator vanes is suppressed.

Furthermore, by disposing the first-stage turbine stator vanes close to the downstream side of sidewalls, the leading edges of the first-stage turbine stator vanes are disposed in relatively cool flows behind (in the wake of) the sidewalls, and thus, the high-temperature combustion gas is less likely to directly collide with the leading edges of the first-stage turbine stator vanes. Accordingly, the need to cool the leading edges of the first-stage turbine stator vanes is reduced, and the flow level of the cooling fluid required for cooling is reduced.

In the communicating structure between the combustors and the turbine portion according to the first aspect of the present invention, it is desirable that the internal surfaces of the sidewalls have shapes that are smoothly continuous with external surfaces of the first-stage turbine stator vanes disposed downstream of the sidewalls.

With this configuration, the combustion gas generated inside the pipe pieces flows along the internal surfaces of the sidewalls and subsequently flows along the external surfaces of the first-stage turbine stator vanes that are smoothly continuous with the sidewalls. Accordingly, as compared with the case in which level differences, etc. are formed between the internal surfaces of the sidewalls and the external surfaces of the first-stage turbine stator vanes thereby making them discontinuous, the flow of combustion gas is less likely to be disturbed and the occurrence of the loss can be suppressed.

Furthermore, because the flow of combustion gas at the external surfaces of the first-stage turbine stator vanes is less likely to be disturbed, for example, in the method in which the first-stage turbine stator vanes are cooled by making the cooling fluid flow in the form of a film at the external surfaces of the first-stage turbine stator vanes, deterioration in the efficiency of cooling the first-stage turbine stator vanes can be suppressed.

On the other hand, an increase in heat transmission rate from the combustion gas to the external surfaces of the first-stage turbine stator vanes is suppressed.

Furthermore, because the leading edges of the first-stage turbine stator vanes, where the temperature thereof most easily reaches a high temperature, are protected by the sidewalls (disposed in the wake of the side walls), exposure to the high-temperature combustion gas is prevented, and the flow level of the cooling fluid required to cool the first-stage turbine stator vanes can be reduced.

In the communicating structure between the combustors and the turbine portion according to the first aspect of the present invention, it is desirable that, as compared with the first-stage turbine stator vanes disposed at locations other than downstream of the sidewalls, the number of cooling holes from which cooling fluid employed to cool the first-stage turbine stator vanes is made to flow out to the peripheries of the first-stage turbine stator vanes be smaller in the first-stage turbine stator vanes disposed downstream of the sidewalls.

With this configuration, the combustion gas is less likely to collide with the leading edges of the first-stage turbine stator vanes disposed downstream of the sidewalls, as compared with the first-stage turbine stator vanes disposed elsewhere. Accordingly, as compared with the first-stage turbine stator vanes disposed at locations other than downstream of the sidewalls, it is possible to reduce the number of cooling holes or shower-head cooling holes, from which the cooling fluid is made to flow out to the peripheries of the first-stage turbine stator vanes disposed downstream of the sidewalls so as to flow along the external surfaces of the first-stage turbine stator vanes in the form of a film. In other words, as compared with the first-stage turbine stator vanes disposed at locations other than downstream of the sidewalls, the flow level of the cooling fluid employed to cool the first-stage turbine stator vanes can be reduced.

In the communicating structure between the combustors and the turbine portion according to the first aspect of the present invention, it is desirable that the cooling fluid for cooling the sidewalls be made to flow through a gap between a sidewall of the one pipe piece and a sidewall of the other pipe piece and that the cooling fluid that has cooled the sidewalls subsequently flow along the peripheries of the first-stage turbine stator vanes disposed downstream of the sidewalls from downstream-side end portions of the sidewalls.

With this configuration, by making the cooling fluid that has flowed between the sidewalls and cooled the sidewalls flow along the peripheries of the first-stage turbine stator vanes in the form of a film from the outflow channels, which are slot-like gaps formed between the downstream-side end portions of the sidewalls and the first-stage turbine stator vanes, the first-stage turbine stator vanes disposed downstream of the sidewalls can be effectively cooled by the cooling fluid. Accordingly, the flow level of the cooling fluid that is supplied to the first-stage turbine stator vanes disposed downstream of the sidewalls and that cools the first-stage turbine stator vanes can be reduced.

In the communicating structure between the combustors and the turbine portion according to the first aspect of the present invention, it is desirable that the downstream-side end portions of the sidewalls be tilted in the direction in which the combustion gas is deflected by the first-stage turbine stator vanes.

With this configuration, the flow of combustion gas can be deflected by the downstream-side end portions of the sidewalls and the first-stage turbine stator vanes.

Furthermore, because the flow of combustion gas is deflected by the sidewalls and the first-stage turbine stator vanes, the size of the communicating structure between the combustors and the turbine portion in the axial direction of the rotating shaft can be reduced. On the other hand, when the deflection by the sidewalls can be increased, the deflection by the first-stage turbine stator vanes can be reduced; therefore, the axial-direction size can be further reduced.

In the communicating structure between the combustors and the turbine portion according to the first aspect of the present invention, it is desirable that the tilted portions of the sidewalls, in cross-sectional view, form airfoil shapes together with the first-stage turbine stator vanes disposed downstream of the sidewalls.

With this configuration, because the tilted portions of the sidewalls have cross-sectional shapes that form airfoil shapes together with the first-state turbine stator vanes, the flow of the combustion can be effectively deflected as compared with the case in which the airfoil shapes are not formed.

A gas turbine according to a second aspect of the present invention is a gas turbine including a compressor that compresses air; a combustor that generates combustion gas by combusting compressed air supplied from the compressor and fuel supplied from a fuel nozzle, which are mixed therein; a turbine portion that converts part of energy possessed by the combustion gas into a rotational driving force; a rotating shaft that transmits the rotational driving force from the turbine portion to the compressor; and the communicating structure between the combustors and the turbine portion of the present invention described above.

With the gas turbine according to the second aspect of the present invention, because it has the communicating portion between the combustors and the turbine portion according to the present invention described above, the occurrence of a loss can be suppressed and the flow level of the cooling volume employed to cool the turbine stator vanes can be reduced; therefore, the efficiency of the gas turbine as a whole can be improved.

Advantageous Effects of Invention

With the communicating structure between combustors and a turbine portion and the gas turbine according to the present invention, an advantage is afforded in that, by disposing first-stage turbine stator vanes positioned downstream of sidewalls closer to end portions of the sidewalls close to a turbine-portion, the occurrence of a loss in a gas turbine can be suppressed, and the flow level of cooling fluid employed to cool turbine blades can also be reduced.

DESCRIPTION OF EMBODIMENTS

First Embodiment

A first embodiment of the present invention will be described below with reference to FIGS. 1 to 3.

Figure 1:
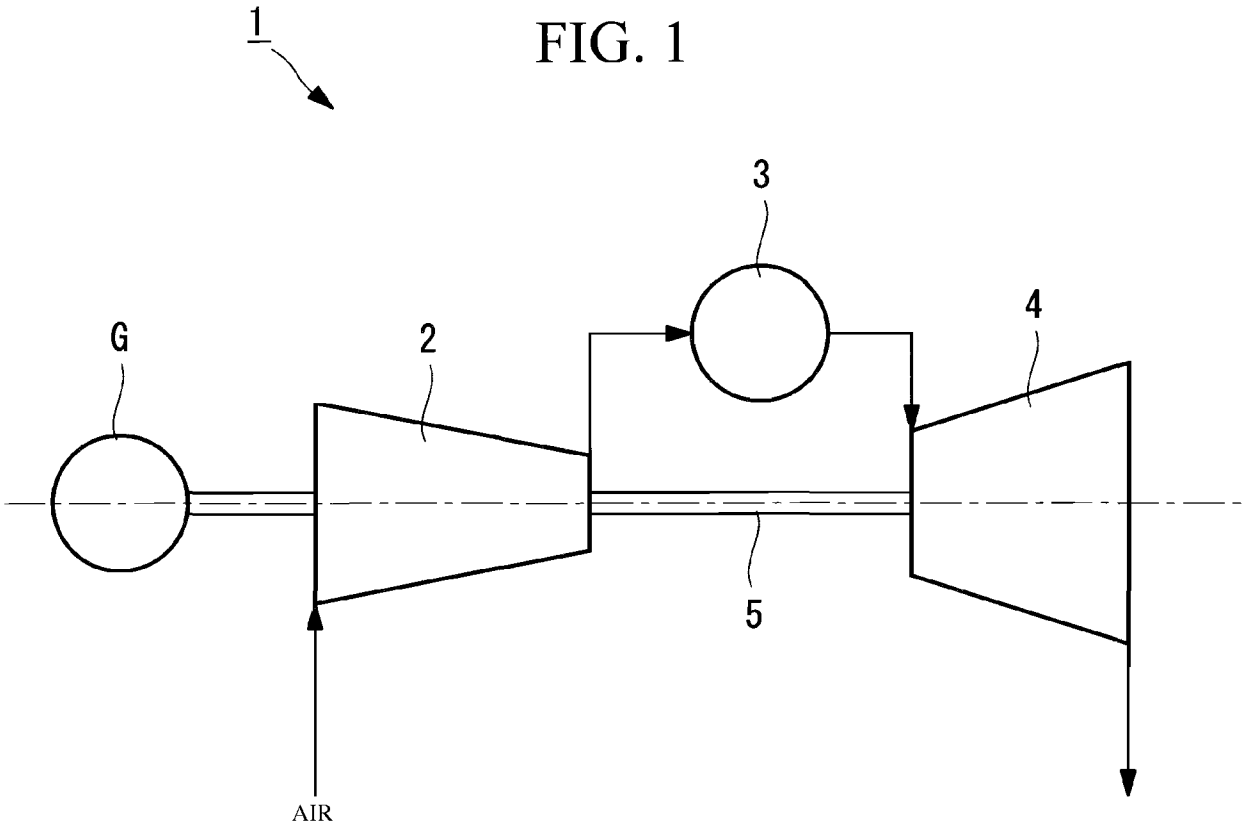
FIG. 1 is a schematic view for explaining the configuration of a gas turbine according to a first embodiment of the present invention.

FIG. 1 is a schematic view for explaining the configuration of a gas turbine according to this embodiment.

As shown in FIG. 1, in this embodiment, a gas turbine 1 of the present invention will be described as applied to one that drives a generator G. However, the object to be driven by the gas turbine 1 is not limited to the generator G, and it may be other equipment; it is not particularly limited.

As shown in FIG. 1, the gas turbine 1 is mainly provided with a compressor 2, combustors 3, a turbine portion 4, and a rotating shaft 5.

The compressor 2 takes in atmospheric air, which is external air, compresses the air, and supplies the compressed air to the combustors 3.

The compressor 2 is provided with an inlet guiding vane (not shown) which adjusts the flow level of the atmospheric air that flows into the compressor 2, first-stage rotor blades (not shown) that compress the atmospheric air that has flowed in, first-stage stator vanes (not shown), and so on.

Figure 2:
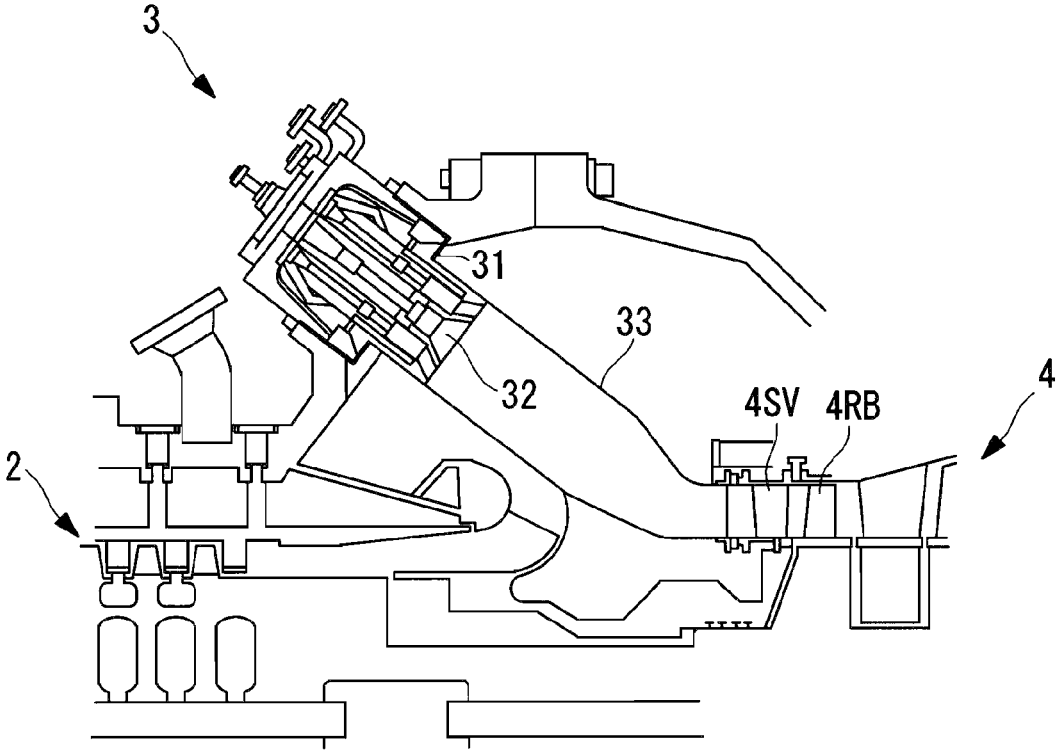
FIG. 2 is a schematic view for explaining the configurations of a compressor, a turbine portion, and a combustor in FIG. 1.

FIG. 2 is a schematic view for explaining the configurations of the compressor, the turbine portion, and the combustor in FIG. 1.

As shown in FIGS. 1 and 2, the combustors 3 are can-type combustors in which the air compressed by the compressor 2 and externally supplied fuel are mixed and that generates high-temperature combustion gas by combusting the mixed air that has been mixed therein.

As shown FIG. 2, the combustors 3 are mainly provided with air inlets 31, fuel nozzles 32, and tail pipes (tube pieces) 33.

As shown in FIG. 2, the air inlets 31 guide the air compressed by the compressor 2 to the interior of the tail pipes 33 and are each disposed in the form of a ring around the fuel nozzles 32. Furthermore, the air inlets 31 impart the air flowing into the interior of the tail pipes 33 with flow speed components in a swirling direction, thus forming circulating flows inside the tail pipes 33.

Note that a known shape can be employed for the air inlets 31; they are not particularly limited.

As shown in FIG. 2, the fuel nozzles 32 spray the externally supplied fuel into the interior of the tail pipes 33. The fuel sprayed from the fuel nozzles 32 is stirred by the airflow formed by the air inlets 31, etc. to form mixed air containing fuel and air.

Note that a known shape can be employed for the fuel nozzles 32; it is not particularly limited.

As shown in FIG. 2, the tail pipes 33 are pipe-shaped members that extend toward an inflow portions of the turbine portion 4 from the air inlets 31 and the fuel nozzles 32. In other words, the tail pipes 33 are where the mixed air containing fuel and air and the combustion gas generated by the combustion of the mixed air flow in the interior thereof.

The sectional shape of the tail pipes 33 near the fuel nozzles 32 is substantially circular, and the sectional shape thereof near the turbine portion 4 is substantially rectangular. Accordingly, the sectional shape of the tail pipes 33 continuously changes from a substantially circular shape to a substantially rectangular shape from the fuel nozzles 32 toward the turbine portion 4.

As shown in FIGS. 1 and 2, the turbine portion 4 receives a supply of high-temperature gas generated by the combustors 3 to generate a rotational driving force and transmits the generated rotational driving force to the rotating shaft 5.

Figure 3:
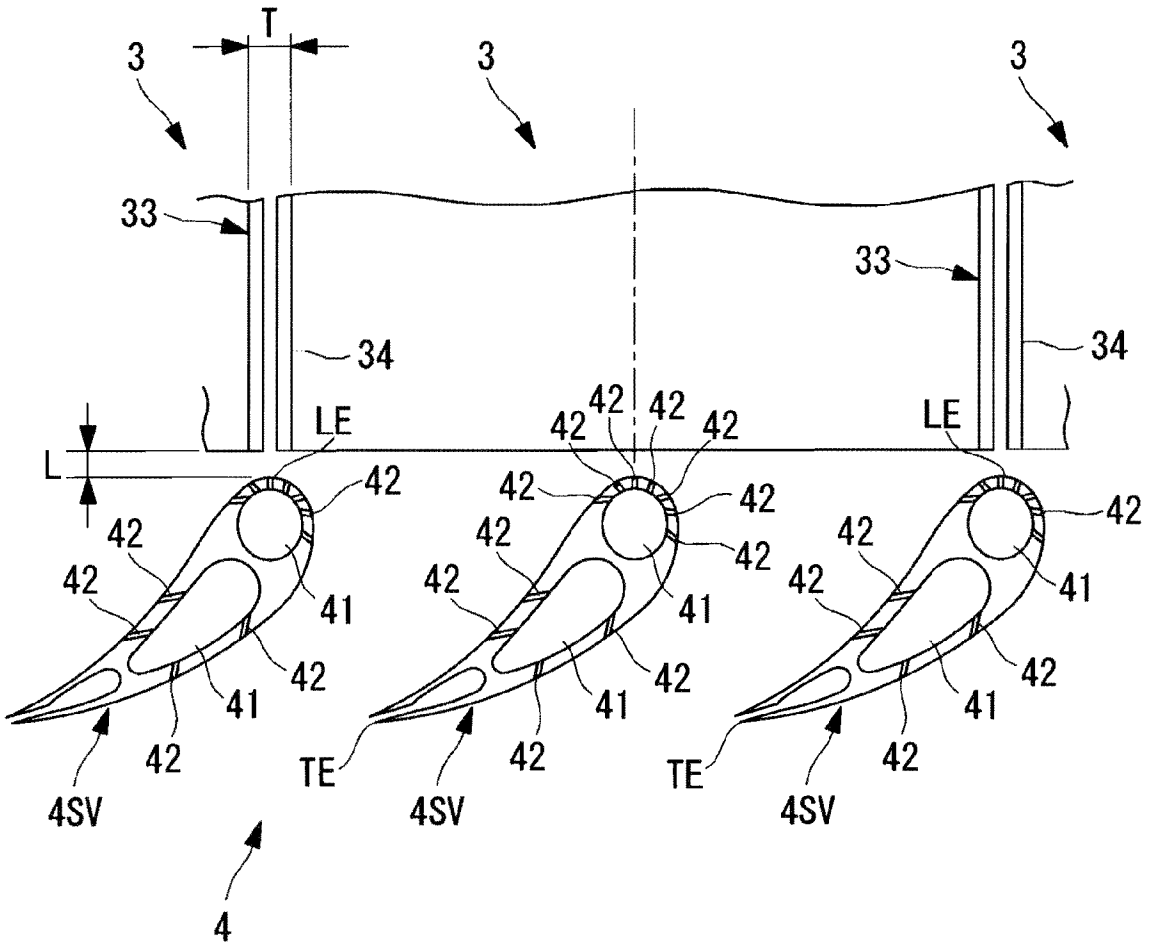
FIG. 3 is a partially enlarged view for explaining a communicating structure between the combustor and the turbine portion in FIG. 1.

FIG. 3 is a partially enlarged view for explaining the communicating structure between the combustor and the turbine portion in FIG. 1.

As shown in FIGS. 2 and 3, the turbine portion 4 is provided with first-stage turbine stator vanes (turbine stator vanes) 4SV and first-stage turbine rotor blades (turbine rotor blades) 4RB.

The first-stage turbine stator vanes 4SV form a turbine stage together with the first-stage turbine rotor blades 4RB and generate the rotational driving force together with the first-stage rotor blades 4RB from the high-temperature gas that has flowed into the turbine portion 4.

The first-stage turbine stator vanes 4SV are a plurality of blades that are arranged around the rotating shaft at equal intervals at positions that face downstream-side end portions (bottom-side end portions in FIG. 3) of the tail pipes 33 with respect to a flow of combustion gas and that are also arranged so as to extend along a radial direction (vertical direction in FIG. 3 with respect to the plane of the drawing). Furthermore, the first-stage turbine stator vanes 4SV deflect the combustion gas that has flowed into a row of the first-stage turbine stator vanes 4SV from the combustors 3 in a circumferential direction (left-right direction in FIG. 3).

In this embodiment, the number of first-stage turbine stator vanes 4SV is an integral multiple of the number of combustors 3, and, at least some of the first-stage turbine stator vanes 4SV are disposed downstream of sidewalls 34 of the tail pipes 33 in the combustors 3, as shown in FIG. 3. Furthermore, the first-stage turbine stator vanes 4SV are arranged so that a distance L from leading edges LE of the first-stage turbine stator vanes 4SV to end portions of the sidewalls 34 closer to the turbine portion 4 is set to be equal to or less than a thickness T which is the sum of the thicknesses of the sidewall 34 of one tail pipe 33 and the sidewall 34 of another tail pipe 33 that are adjacent to each other, and gaps between the two sidewalls 34 and 34 are combined, in other words, the thickness T (hereinafter, referred to as "thickness T related to the sidewalls 34") is the spacing between the inner surface of the sidewall 34 of one tail pipe 33 and the inner surface of the sidewall 34 of another tail pipe, which are adjacent to each other.

Furthermore, the first-stage turbine stator vanes 4SV are provided with cavities 41 to which cooling air (cooling fluid) that protects the first-stage turbine stator vanes 4SV from the heat of the high-temperature gas flowing in the peripheries thereof is supplied and are provided with a plurality of cooling holes 42 that perform film cooling wherein the cooling air is made to flow out into the peripheries of the first-stage turbine stator vanes 4SV from the cavities 41.

The cooling holes 42 are arranged in a large number at the leading edges LE of the first-stage turbine stator vanes 4SV, where the heat load is high, so that the leading edges LE are formed like shower heads.

When the numbers of cooling holes 42 at the leading edges LE are compared between the first-stage turbine stator vanes 4SV disposed downstream of the sidewalls 34 and the rest of the first-stage turbine stator vanes 4SV, a smaller number of cooling holes 42 is formed at the leading edges LE of the first-stage turbine stator vanes 4SV disposed downstream of the sidewalls 34.

The first-stage turbine rotor blades 4RB form the turbine stage together with the first-stage turbine stator vanes 4SV and generate the rotational driving force on the basis of the combustion gas deflected by the first-stage turbine stator vanes 4SV.

The first-stage turbine rotor blades 4RB are a plurality of blades that are arranged around the rotating shaft at equal intervals at positions downstream (right-side positions in FIG. 2) of the first-stage turbine stator vanes 4SV with respect to the flow of combustion gas and that are also arranged so as to extend along the radial direction (top-bottom direction in FIG. 2). Furthermore, the first-stage turbine rotor blades 4RB receive the combustion gas deflected by the first-stage turbine stator vanes 4SV and rotationally drive the rotating shaft 5.

Furthermore, cooling air that protects the first-stage turbine rotor blades 4RB from the heat of the combustion gas that flows in the peripheries thereof is supplied to the first-stage turbine rotor blades 4RB.

Note that the turbine portion 4 may be provided only with the first-stage turbine stator vanes 4SV and the first-stage turbine rotor blades 4RB, as described above, or second-stage turbine stator vanes and second-stage turbine rotor blades, third-stage turbine stator vanes and third-stage turbine rotor blades, and so on may be additionally provided; it is not particularly limited.

Next, the general operation of the thus-configured gas turbine 1 and the flow of the combustion gas from exits of the combustors 3 to the first-stage turbine stator vanes 4SV, which is a feature of this embodiment, will be described.

As shown in FIG. 1, the gas turbine 1 takes in the atmospheric air (air) when the compressor 2 is rotationally driven. The air that has been taken in is compressed by the compressor 2 and is discharged toward the combustor 3.

The compressed air that has flowed into the combustors 3 is mixed with the externally supplied fuel at the combustors 3. The mixed air containing fuel and air is combusted in the combustors 3, and the combustion gas is generated.

The combustion gas generated in the combustors 3 is supplied to the turbine portion 4 downstream of the combustors 3.

As shown in FIG. 3, the combustion gas flows out from the tail pipes 33 of the combustors 3 and flows into the row of the first-stage turbine stator vanes 4SV in the turbine 4.

At this time, because the first-stage turbine stator vanes 4SV are disposed close to the tail pipes 33, the combustion gas is less likely to flow in between the first-stage turbine stator vanes 4SV disposed downstream of the sidewalls 34 of the tail pipes 33 and the tail pipes 33, and a loss due to this flow is less likely to occur.

Furthermore, the leading edges LE of the first-stage turbine stator vanes 4SV disposed downstream of the sidewalls 34 are positioned in flows behind (in the wake of) the sidewalls 34; therefore, the combustion gas is less likely to directly collide with the leading edges LE.

The flow direction of the combustion gas that has flowed into the row of the first-stage turbine stator vanes 4SV is deflected in the circumferential direction (left-right direction in FIG. 3), centered around the rotating shaft 5, and flows into the row of the first-stage turbine rotor blades 4RB, as shown in FIG. 2.

The first-stage turbine rotor blades 4RB are rotationally driven by the deflected combustion gas. The rotational driving force generated in this way at the turbine portion 4 is transmitted to the rotating shaft 5. The rotating shaft 5 transmits the rotational driving force extracted at the turbine portion 4 to the compressor 2 and the generator G.

With the above-described configuration, the first-stage turbine stator vanes 4SV positioned downstream of the sidewalls 34 are disposed close to the end portions of the sidewalls 34 closer to the turbine portion 4, and thereby, the combustion gas is prevented from flowing in between the sidewalls 34 and the first-stage turbine stator vanes 4SV. Because of this, the occurrence of loss caused by having the combustion gas flow in between the sidewalls 34 and the first-stage turbine stator vanes 4SV can be suppressed.

Furthermore, by disposing the first-stage turbine stator vanes 4SV close to the downstream side of the sidewalls 34, the leading edges LE of the first-stage turbine stator vanes 4SV are disposed in relatively cool flows behind (in the wake of) the sidewalls 34, and the high-temperature combustion gas is less likely to directly collide with the leading edges LE of the first-stage turbine stator vanes 4SV. Because of this, the need to cool the leading edges LE of the first-stage turbine stator vanes 4SV is reduced, and the flow level of the cooling air required for cooling can be reduced.

The combustion gas is less likely to collide with the first-stage turbine stator vanes 4SV disposed downstream of the sidewalls 34 at the leading edges LE thereof as compared with the first-stage turbine stator vanes 4SV disposed elsewhere. Accordingly, as compared with the first-stage turbine stator vanes 4SV disposed at locations other than downstream of the sidewalls 34, it is possible to reduce the number of cooling holes 42 in the first-stage turbine stator vanes 4SV, which cause the cooling air to flow along external surfaces thereof in the form of a film by making the cooling air flow out therefrom to the peripheries of the first-stage turbine stator vanes 4SV. In other words, as compared with the first-stage turbine stator vanes 4SV disposed at the locations other than the downstream of the sidewalls 34, it is possible to reduce the flow level of the cooling air employed to cool the first-stage turbine stator vanes 4SV disposed downstream of the sidewalls 34.

Second Embodiment

Next, a second embodiment of the present invention will be described with reference to FIGS. 4 and 5.

Although the basic configuration of a gas turbine of this embodiment is the same as that of the first embodiment, a communicating structure between the combustors and the turbine portion differs from that in the first embodiment. Therefore, only the communicating structure between the combustors and the turbine portion will be described in this embodiment by using FIGS. 4 and 5, and descriptions of other components, etc. will be omitted.

Figure 4:
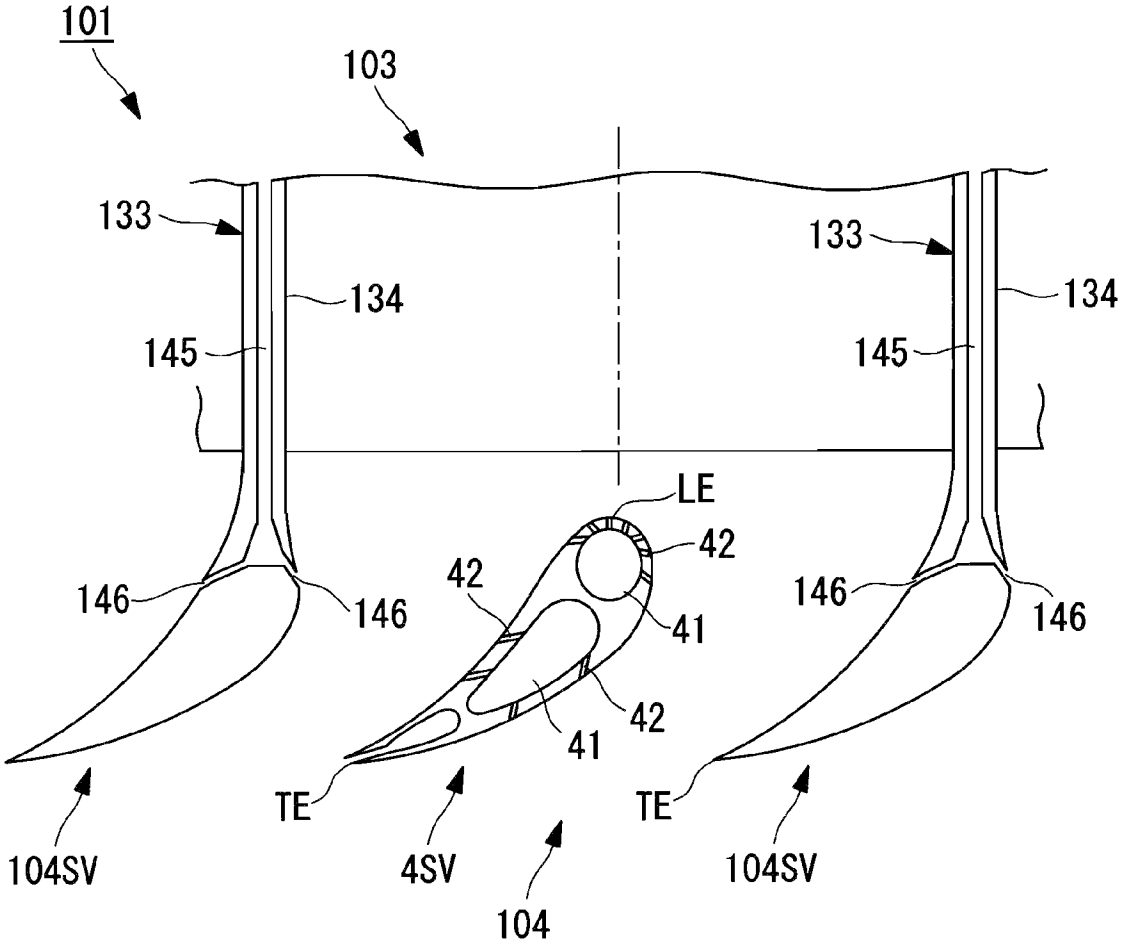
FIG. 4 is a partially enlarged view for explaining a communicating structure between a combustor and a turbine portion in a gas turbine according to a second embodiment of the present invention.

FIG. 4 is a partially enlarged view for explaining the communicating structure between the combustors and the turbine portion in the gas turbine according to this embodiment.

Note that, components that are the same as those in the first embodiment are given the same reference signs, and descriptions thereof will be omitted.

As shown in FIG. 4, combustors 103 in a gas turbine 101 in this embodiment differ from those of the first embodiment in the shapes of the end portions (bottom-side end portions in FIG. 4) of sidewalls 134 of tail pipes (pipe pieces) 133 closer to a turbine portion 104.

Specifically, as shown in FIG. 4, cooling channels 145 in which cooling fluid (for example, compressed air compressed by the compressor 2), such as cooling air, etc., flows and that extend in a direction (top-bottom direction in FIG. 4) in which the combustion gas flows are provided between the tail pipes 133 of adjacent combustors 103.

End portions of the cooling channels 145 closer to the turbine portion 104 are opened at the end portions (bottom-side end portions in FIG. 4) of the sidewalls 134 of the end pipes 133 closer to the turbine portion 104.

Figure 5:
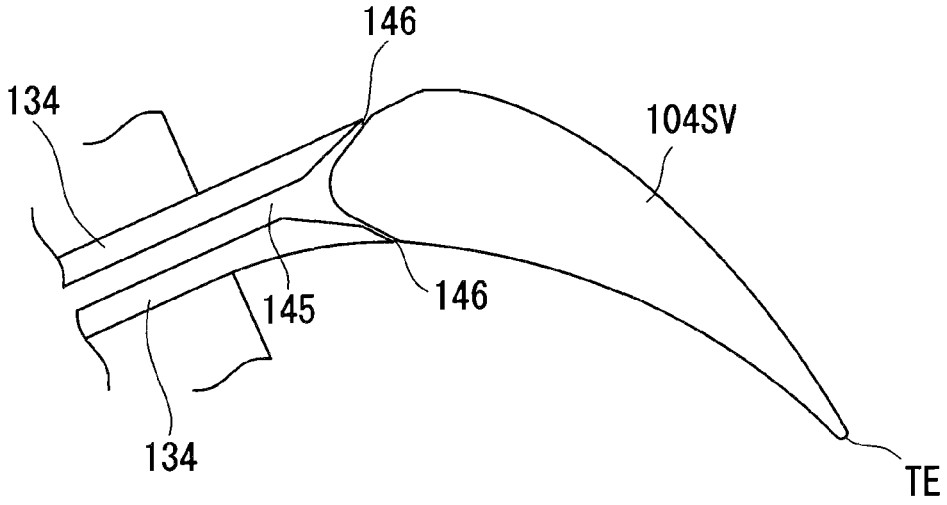
FIG. 5 is an enlarged view for explaining the configurations of sidewalls and first-stage turbine stator vanes in FIG. 4.

FIG. 5 is an enlarged view for explaining the configurations of the sidewalls and the first-stage turbine stator vanes in FIG. 4.

Furthermore, as shown in FIGS. 4 and 5, the downstream-side end portions of the sidewalls 134 are formed in shapes such that internal surfaces of the sidewalls 134 are smoothly continuous with external surfaces of first-stage turbine stator vanes 104SV adjacent thereto. In other words, the sidewalls 134 are formed so that the widths of the sidewalls 134 are increased toward the first-stage turbine stator vanes 104SV.

On the other hand, the first-stage turbine stator vanes 4SV and first-stage turbine stator vanes (turbine stator vanes) 104SV are provided at the turbine portion 104 in the gas turbine 101 of this embodiment, as shown in FIG. 4.

The first-stage turbine stator vanes 4SV and the first-stage turbine stator vanes 104SV form a turbine stage together with the first-stage turbine rotor blades 4RB and generate a rotational driving force together with the first-stage rotor blades 4RB from the combustion gas that has flowed into the turbine portion 104. Furthermore, the first-stage turbine stator vanes 4SV and the first-stage turbine stator vanes 104SV are a plurality of blades that are arranged at equal intervals on the same circumference around the rotating shaft 5 and that are also arranged so as to extend along the radial direction (vertical direction in FIG. 4 with respect to the plane of the drawing).

As shown in FIG. 4, the first-stage turbine stator vanes 4SV are turbine stator vanes disposed between the sidewalls 134, in other words, turbine stator vanes disposed between the first-stage turbine stator vanes 104SV.

The first-stage turbine stator vanes 104SV are turbine stator vanes disposed at positions facing the downstream-side end portions (bottom-side end portions in FIG. 4) of the end pipes 133 with respect to the flow of combustion gas, in other words, turbine stator vanes disposed between the first-stage turbine stator vanes 4SV.

Unlike the first-stage turbine stator vanes 4SV, the cavities 41 inside which the cooling air is supplied and the cooling holes 42 from which the cooling air from the cavities 41 is made to flow out to the peripheries of the first-stage turbine stator vanes 104SV are not formed in the first-stage turbine stator vanes 104SV.

On the other hand, as shown in FIGS. 4 and 5, outflow channels 146 that communicate with the cooling channels 145 at the sidewalls 134 and from which the cooling air, after flowing through the cooling channels 145, flows out along the peripheries of the first-stage turbine stator vanes 104SV in the form of a film are provided between the first-stage turbine stator vanes 104SV and the sidewalls 134.

The outflow channels 146 are long, narrow slots that extend from the cooling channels 145 toward the outer side of the sidewalls 134 in the downstream direction (right direction in FIG. 5) of the flow of combustion gas.

Next, the flow of combustion gas from the exits of the combustors 103 to the first-stage turbine stator vanes 4SV and the first-stage turbine stator vanes 104SV, which is a feature of this embodiment, will be described.

Note that, because the general operation of the gas turbine 101 is the same as that in the first embodiment, a description thereof will be omitted.

As shown in FIGS. 4 and 5, the combustion gas flows out from the tail pipes 133 of the combustors 103 and flows into a row of the first-stage turbine stator vanes 4SV and the first-stage turbine stator vanes 104SV at the turbine portion 104.

Specifically, the combustion gas that has flowed along the internal surfaces of the sidewalls 134 of the tail pipes 133 is deflected while flowing along the external surfaces of first-stage turbine stator vanes 104SV from the internal surface of the sidewalls 134.

At the same time, the cooling air that has flowed through the cooling channels 145 and cooled the tail pipes 133 flows out along the external surfaces of the first-stage turbine stator vanes 104SV via the outflow channels 146. The cooling air flows along the external surfaces of the first-stage turbine stator vanes 104SV in the form of a film and cools the first-stage turbine stator vanes 104SV.

On the other hand, as in the case of the first embodiment, the combustion gas that has flowed through the centers of the tail pipes 133 collides with the first-stage turbine stator vanes 4SV and is deflected while flowing along the surfaces of the first-stage turbine stator vanes 4SV.

With the above-described configuration, the combustion gas generated inside the tail pipes 133 flows along the internal surfaces of the sidewalls 134 and subsequently flows along the external surfaces of the first-stage turbine stator vanes 104SV, which are smoothly continuous therewith. Accordingly, as compared with the case in which the internal surfaces of the sidewalls 134 and the external surfaces of the first-stage turbine stator vanes 104SV are discontinuous due to the formation of a level difference, etc. therebetween, the flow of combustion gas is less likely to be disturbed, and loss can be suppressed.

Furthermore, because the flow of combustion gas at the external surfaces of the first-stage turbine stator vanes 104SV is less likely to be disturbed, with the approach in which the cooling air that has flowed out from the outflow channels 146 is made to flow at the external surfaces of the first-stage turbine stator vanes 104SV in the form of a film to cool the first-stage turbine stator vanes 104SV, deterioration of the cooling efficiency of the first-stage turbine stator vanes 104SV can be prevented.

By making the cooling air that has cooled the sidewalls 134 flow along the external surfaces of the first-stage turbine stator vanes 104SV, the first-stage turbine stator vanes 104SV disposed downstream of the sidewalls 134 can be cooled with the cooling air. Accordingly, it is possible to reduce the flow level of the cooling air to be supplied to the first-stage turbine stator vanes 104SV to cool the first-stage turbine stator vanes 104SV.

Third Embodiment

Next, a third embodiment of the present invention will be described with reference to FIG. 6.

Although the basic configuration of a gas turbine of this embodiment is the same as that of the first embodiment, a communicating structure between the combustors and the turbine portion differs from that in the first embodiment. Therefore, only the communicating structure between the combustors and the turbine portion will be described in this embodiment by using FIG. 6, and descriptions of other components, etc. will be omitted.

Figure 6:
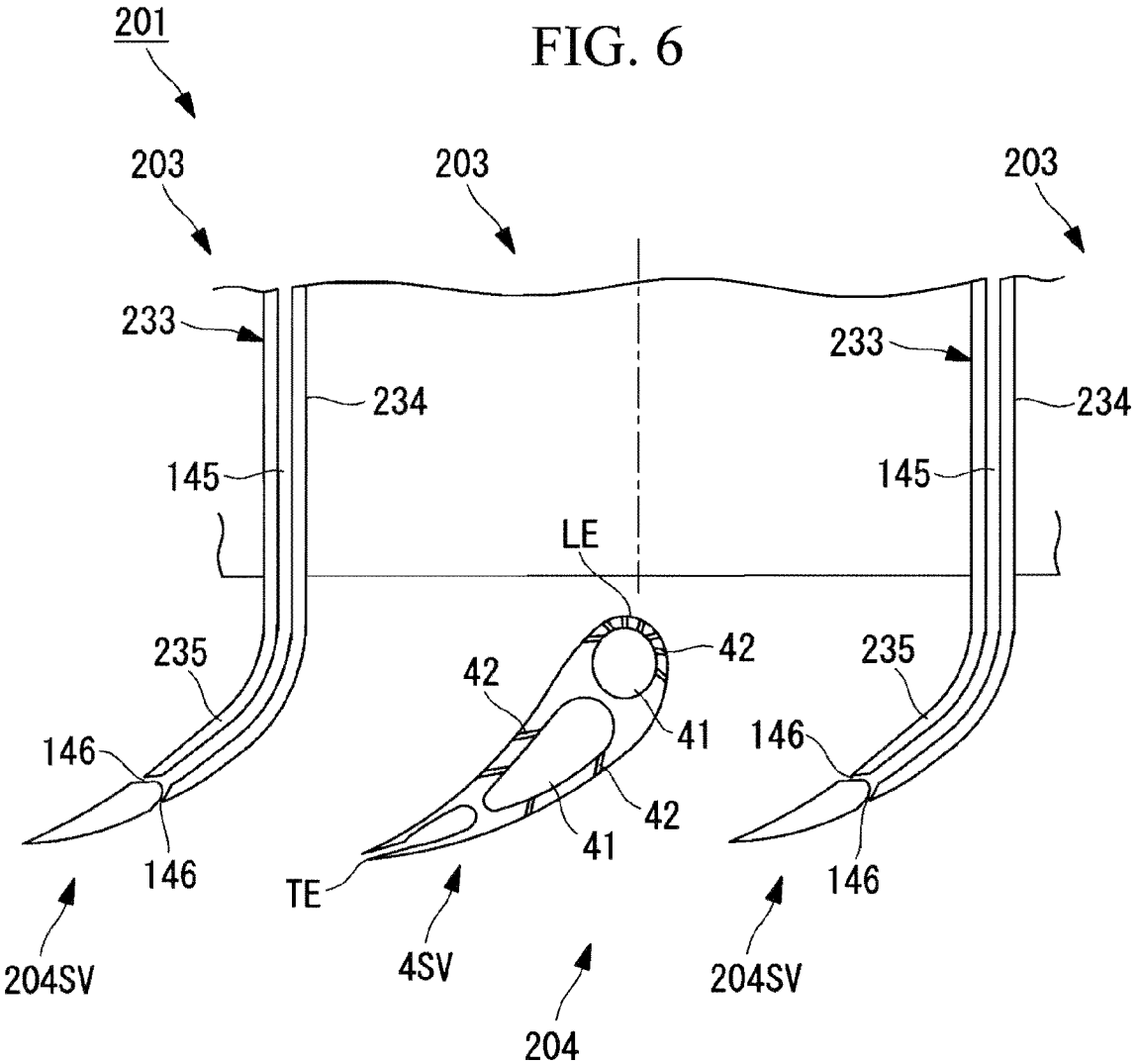
FIG. 6 is a partially enlarged view for explaining a communicating structure between a combustor and a turbine portion in a gas turbine according to a third embodiment of the present invention.

FIG. 6 is a partially enlarged view for explaining the communicating structure between the combustors and the turbine portion in the gas turbine according to this embodiment.

Note that components that are the same as those in the first embodiment are given the same reference signs, and descriptions thereof will be omitted.

As shown in FIG. 6, a combustor 203 in a gas turbine 201 of this embodiment differs from that in the first embodiment in the shapes of the end portions (bottom-side end portions in FIG. 6) of sidewalls 234 of tail pipes (pipe pieces) 233 closer to a turbine portion 204.

Specifically, as shown in FIG. 6, the sidewalls 234 of the tail pipes 233 in the combustors 203 are provided with tilted portions 235 that are tilted in the direction in which the first-stage turbine stator vanes 4SV deflect the flow of combustion gas.

The tilted portions 235 are end portions of the sidewalls 234 closer to the turbine portion 204 and are portions adjacent to the first-stage turbine stator vanes 204SV. Furthermore, because the tilted portions 235 are formed by tilting the sidewalls 234 without other modifications, the thickness-wise size of the tilted portions 235 and the thickness-wise size of parts of the sidewalls 234 other than the tilted portions 235 are the same.

As shown in FIG. 6, the tail pipes 233 and the sidewalls 234 are provided with cooling channels 145 that extend along the direction in which the combustion gas flows (top-bottom direction in FIG. 6) and inside which cooling fluid, such as cooling air, etc., flows. Furthermore, the cooling channels 145 extend along the tilted portions 235 inside the tilted portions 235 of the sidewalls 234.

The end portions of the cooling channels 145 closer to the turbine portion 204 open at the end portions (bottom-side end portions in FIG. 6) of the tilted portions 235 of the sidewalls 234 closer to the turbine portion 204.

On the other hand, as shown in FIG. 6, the turbine portion 204 of the gas turbine 201 in this embodiment is provided with the first-stage turbine stator vanes 4SV and the first-stage turbine stator vanes (turbine stator vanes) 204SV.

The first-stage turbine stator vanes 4SV and the first-stage turbine stator vanes 204SV form a turbine stage together with the first-stage turbine rotor blades 4RB and generate a rotational driving force together with the first-stage rotor blades 4RB from the combustion gas that has flowed into the turbine portion 204. Furthermore, the first-stage turbine stator vanes 4SV and the first-stage turbine stator vanes 204SV are a plurality of blades that are arranged at equal intervals on the same circumference around the rotating shaft 5 and that are also arranged so as to extend along the radial direction (vertical direction in FIG. 6 with respect to the plane of the drawing).

As shown in FIG. 6, the first-stage turbine stator vanes 4SV are turbine stator vanes disposed between the sidewalls 234 and the tilted portions 235, in other words, turbine stator vanes disposed between the first-stage turbine stator vanes 204SV.

The first-stage turbine stator vanes 204SV are turbine stator vanes disposed at positions facing the downstream-side end portions (bottom-side end portions in FIG. 6) of the tilted portions 235 with respect to the flow of combustion gas, in other words, turbine stator vanes disposed between the first-stage turbine stator vanes 4SV.

The first-stage turbine stator vanes 204SV are formed with a smaller sectional area as compared with the first-stage turbine stator vanes 4SV, and a portion in the first-stage turbine stator vanes 204SV where the thickness-wise size is the largest has the same thickness-wise size as the tilted portions 235.

Unlike the first-stage turbine stator vanes 4SV, the cavities 41 inside which the cooling air is supplied and the cooling holes 42 from which the cooling air from the cavities 41 is made to flow out to the peripheries of the first-stage turbine stator vanes 204SV are not formed in the first-stage turbine stator vanes 204SV.

On the other hand, as shown in FIG. 6, outflow channels 146 that communicate with the cooling channels 145 at the tilted portions 235 and from which the cooling air, after flowing through the cooling channels 145, flows out along the peripheries of the first-stage turbine stator vanes 204SV are provided between the first-stage turbine stator vanes 204SV and the tilted portions 235.

The outflow channels 146 are through-holes that extend from the cooling channels 145 toward the outer side of the tilted portions 235 in the downstream direction (left-bottom direction in FIG. 6) of the flow of combustion gas.

Next, the flow of combustion gas from the exits of the combustors 203 to the first-stage turbine stator vanes 4SV and the first-stage turbine stator vanes 204SV, which is a feature of this embodiment, will be described.

Note that, because the general operation of the gas turbine 201 is the same as that in the first embodiment, a description thereof will be omitted.

As shown in FIG. 6, the combustion gas flows out from the tail pipes 233 of the combustors 203 and flows into the row of the first-stage turbine stator vanes 4SV and the first-stage turbine stator vanes 204SV at the turbine portion 204.

Specifically, the combustion gas that has flowed along the internal surfaces of the sidewalls 234 of the tail pipes 233 is deflected while flowing along the internal surfaces of the tilted portions 235 at the sidewalls 234 and the external surfaces of first-stage turbine stator vanes 204SV.

At the same time, the cooling air that has flowed through the cooling channels 145 and cooled the tail pipes 233 and the tilted portions 235 flows out along the external surfaces of the first-stage turbine stator vanes 204SV via the outflow channels 146. The cooling air flows along the external surfaces of the first-stage turbine stator vanes 204SV in the form of a film and cools the first-stage turbine stator vanes 204SV.

On the other hand, as in the case of the first embodiment, the combustion gas that has flowed through the interior of the tail pipes 233 collides with the first-stage turbine stator vanes 4SV and is deflected while flowing along the surfaces of the first-stage turbine stator vanes 4SV.

With the above-described configuration, the flow of combustion gas can be deflected by the tilted portions 235, which are the downstream-side end portions of the sidewalls 234, and the first-stage turbine stator vanes 204SV.

Furthermore, because the flow of combustion gas is deflected by the tilted portions 235 and the first-stage turbine stator vanes 204SV, it is possible to reduce the size of the communicating structure between the combustors 203 and the turbine portion 204 in the axial direction (top-down direction FIG. 6) of the rotating shaft 5.

If the deflection by the sidewalls 234 can be further increased, the deflection by the first-stage turbine stator vanes 204SV can be reduced; therefore, the size in the axial direction of the rotating shaft 5 can be further reduced.

Fourth Embodiment

Next, a fourth embodiment of the present invention will be described with reference to FIG. 7.

Although the basic configuration of a gas turbine of this embodiment is the same as that of the first embodiment, a communicating structure between the combustors and the turbine portion differs from that in the first embodiment. Therefore, only the communicating structure between the combustors and the turbine portion will be described in this embodiment by using FIG. 7, and descriptions of other components, etc. will be omitted.

Figure 7:
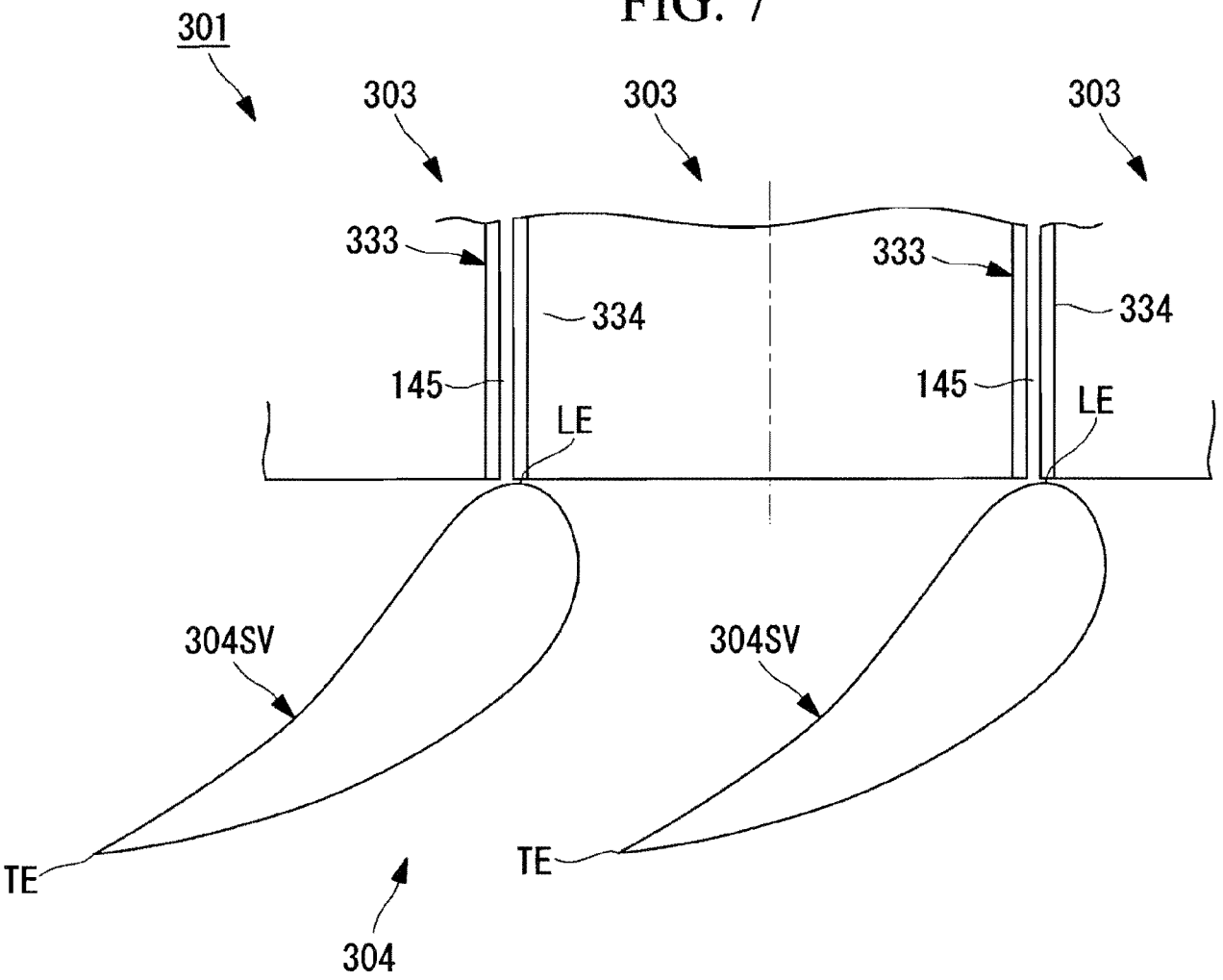
FIG. 7 is a partially enlarged view for explaining a communicating structure between a combustor and a turbine portion in a gas turbine according to a fourth embodiment of the present invention.

FIG. 7 is a partially enlarged view for explaining the communicating structure between the combustors and the turbine portion in the gas turbine according to this embodiment.

Note that components that are the same as those in the first embodiment are given the same reference signs, and descriptions thereof will be omitted.

As shown in FIG. 7, a turbine portion 304 in a gas turbine 101 of this embodiment differs from that in the first embodiment in the shapes and arrangement of first-stage turbine stator vanes (turbine stator vanes) 304SV.

The first-stage turbine stator vanes 304SV form a turbine stage together with the first-stage turbine rotor blades 4RB and generate a rotational driving force together with the first-stage rotor blades 4RB from the combustion gas that has flowed into the turbine portion 304. Furthermore, the first-stage turbine stator vanes 304SV are a plurality of blades that are arranged at equal intervals on the same circumference around the rotating shaft 5 and that are also arranged so as to extend along the radial direction (vertical direction in FIG. 7 with respect to the plane of the drawing).

The first-stage turbine stator vanes 304SV are disposed at positions facing the downstream-side end portions (bottom-side end portions in FIG. 7) of the sidewalls 334 of tail pipes 333 with respect to the flow of combustion gas. In other words, the first-stage turbine stator vanes 304SV are provided in the same number as the number of combustors 303.

The first-stage turbine stator vanes 304SV have similar shapes to the first-stage turbine stator vanes 4SV in the first embodiment, etc. and are formed with larger sectional areas.

Specifically, leading edges LE of the first-stage turbine stator vanes 304SV are disposed at positions separated from the downstream-side end portions of the sidewalls 334, at most, by the thickness T related to the sidewalls 334, and trailing edges TE of the first-stage turbine stator vanes 304SV are disposed at the same positions as trailing edges TE of conventional first-stage turbine stator vanes.

Next, the flow of combustion gas from exits of the combustors 303 to the first-stage turbine stator vanes 304SV, which is a feature of this embodiment, will be described.

Note that, because the general operation of the gas turbine 301 is the same as that in the first embodiment, a description thereof will be omitted.

As shown in FIG. 7, the combustion gas flows out from the tail pipes 333 of the combustors 103 and flows into the row of the first-stage turbine stator vanes 304SV at the turbine portion 304.

Specifically, the combustion gas that has flowed along the internal surfaces of the sidewalls 334 of the tail pipes 333 is deflected while flowing along the external surfaces of the first-stage turbine stator vanes 304SV.

At the same time, the cooling air that has flowed through the cooling channels 145 and cooled the tail pipe 333 flows out along the external surfaces of the first-stage turbine stator vanes 304SV from the downstream-side end portions of the sidewalls 334. The cooling air flows along the external surfaces of the first-stage turbine stator vanes 304SV in the form of a film and cools the first-stage turbine stator vanes 304SV.

With this configuration, as compared with the first embodiment, etc., the number of the first-stage turbine stator vanes 304SV can be reduced. Accordingly, a reduction in flow speed of the combustion gas due to friction or the like that acts between the first-stage turbine stator vanes 304SV and the combustion gas can be suppressed, and the loss caused by this can be suppressed.

Fifth Embodiment

Next, a fifth embodiment of the present invention will be described with reference to FIG. 8.

Although the basic configuration of a gas turbine of this embodiment is the same as that of the first embodiment, a communicating structure between the combustors and the turbine portion differs from that in the first embodiment. Therefore, only the communicating structure between the combustors and the turbine portion will be described in this embodiment by using FIG. 8, and descriptions of other components, etc. will be omitted.

Figure 8:
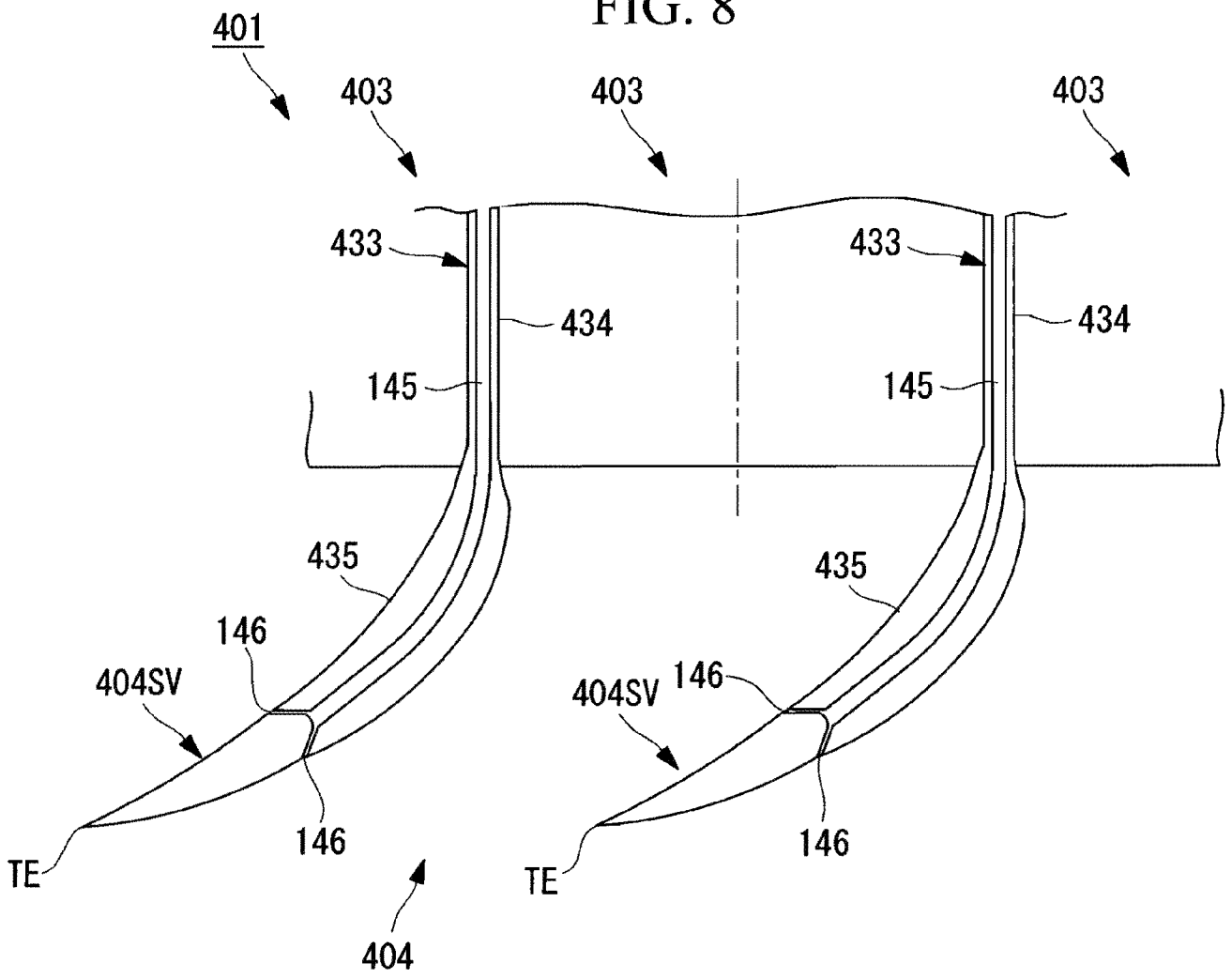
FIG. 8 is a partially enlarged view for explaining a communicating structure between a combustor and a turbine portion in a gas turbine according to a fifth embodiment of the present invention.

FIG. 8 is a partially enlarged view for explaining the communicating structure between the combustors and the turbine portion in the gas turbine according to this embodiment.

Note that components that are the same as those in the first embodiment are given the same reference signs, and descriptions thereof will be omitted.

As shown in FIG. 8, combustors 403 in a gas turbine 401 of this embodiment differ from those in the first embodiment in the shapes of the end portions (bottom-side end portions in FIG. 8) of sidewalls 434 of tail pipes (pipe pieces) 433 closer to a turbine portion 404.

Specifically, as shown in FIG. 8, the sidewalls 434 of the tail pipes 433 in the combustors 403 are provided with tilted portions 435 that deflect the flow of combustion gas leftward in FIG. 8.

The tilted portions 435 are end portions of the sidewalls 434 closer to the turbine portion 404 and are portions adjacent to the first-stage turbine stator vanes 404SV. Furthermore, the tilted portions 435 are formed in shapes whose cross-sections form airfoil shapes together with the first-stage turbine stator vanes 404SV.

Furthermore, upstream-side end portions (top-side end portions in FIG. 8) of the tilted portions 435 with respect to the flow of combustion gas are at positions equivalent to the leading edges LE of the first-stage turbine stator vanes 304SV in the fourth embodiment.

As shown in FIG. 8, the cooling channels 145 in which cooling fluid (for example, compressed air compressed in the compressor 2), such as cooling air, flows and that extend along the direction (top-down direction in FIG. 8) in which the combustion gas flows are provided between adjacent tail pipes 433. Furthermore, the cooling channels 145 extend along the tilted portions 435, between the tilted portions 435 of adjacent sidewalls 434.

End portions of the cooling channels 145 open at downstream-side end portions (bottom-side end portions in FIG. 8) of the tilted portions 435 of the sidewalls 434.

On the other hand, as shown in FIG. 8, the turbine portion 404 of the gas turbine 401 in this embodiment is provided with the first-stage turbine stator vanes (turbine stator vanes) 404SV.

The first-stage turbine stator vanes 404SV form a turbine stage together with the first-stage turbine rotor blades 4RB and generate a rotational driving force together with the first-stage rotor blades 4RB from the combustion gas that has flowed into the turbine portion 404. Furthermore, the first-stage turbine stator vanes 404SV are a plurality of blades that are arranged at equal intervals on the same circumference around the rotating shaft 5 and that are also arranged so as to extend along the radial direction (vertical direction in FIG. 8 with respect to the plane of the drawing).

The first-stage turbine stator vanes 404SV are turbine stator vanes disposed at positions facing the downstream-side end portions (bottom-side end portions in FIG. 8) of the tilted portions 435 with respect to the flow of combustion gas.

The first-stage turbine stator vanes 404SV are formed with smaller sectional areas as compared with the first-stage turbine stator vanes 4SV in the first embodiment and form airfoil shapes together with the tilted portions 435.

Furthermore, trailing edges TE of the first-stage turbine stator vanes 404SV are disposed at the same positions as the trailing edges TE of the first-stage turbine stator vanes 4SV in the first embodiment, etc.

Unlike the first-stage turbine stator vanes 4SV in the first embodiment, the cavities 41 inside which the cooling air is supplied and the cooling holes 42 from which the cooling air from the cavities 41 is made to flow out to the peripheries of the first-stage turbine stator vanes 404SV are not formed in the first-stage turbine stator vanes 404SV.

On the other hand, as shown in FIG. 8, the outflow channels 146 that communicate with the cooling channels 145 and from which the cooling air, after flowing through the cooling channels 145, flows out along external surfaces of the first-stage turbine stator vanes 404SV in the form of a film are provided between the first-stage turbine stator vanes 404SV and the tilted portions 435.

The outflow channels 146 are long, narrow slots that extend from the cooling channels 145 toward the outer side of the tilted portions 435 in the downstream direction (left-bottom direction in FIG. 8) of the flow of combustion gas.

Next, the flow of combustion gas from exits of the combustors 403 to the first-stage turbine stator vanes 404SV, which is a feature of this embodiment, will be described.

Note that, because the general operation of the gas turbine 401 is the same as that in the first embodiment, a description thereof will be omitted.

As shown in FIG. 8, the combustion gas flows out from the tail pipes 433 of the combustors 403 and flows into the row of the first-stage turbine stator vanes 404SV at the turbine portion 404.

Specifically, the combustion gas that has flowed along the internal surfaces of the sidewalls 434 of the tail pipes 433 is deflected while flowing along the internal surfaces of the tilted portions 435 at the sidewalls 434 and the external surfaces of first-stage turbine stator vanes 404SV.

At the same time, the cooling air that has flowed through the cooling channels 145 and cooled the tail pipes 433 and the tilted portions 435 flows out along the external surfaces of the first-stage turbine stator vanes 404SV via the outflow channels 146. The cooling air flows along the external surfaces of the first-stage turbine stator vanes 404SV in the form of a film and cools the first-stage turbine stator vanes 404SV.

With the above-described configuration, because the cross-sections of the tilted portions 435 at the sidewalls 434 have shapes that form airfoil shapes together with the first-stage turbine stator vanes 404SV, as compared with the case in which the airfoil shapes are not formed, the flow of combustion gas can be effectively deflected.

Sixth Embodiment

Next, a sixth embodiment of the present invention will be described with reference to FIG. 9.

Although the basic configuration of a gas turbine of this embodiment is the same as that of the first embodiment, a communicating structure between the combustors and the turbine portion differs from that in the first embodiment. Therefore, only the communicating structure between the combustors and the turbine portion will be described in this embodiment by using FIG. 9, and descriptions of other components, etc. will be omitted.

Figure 9:
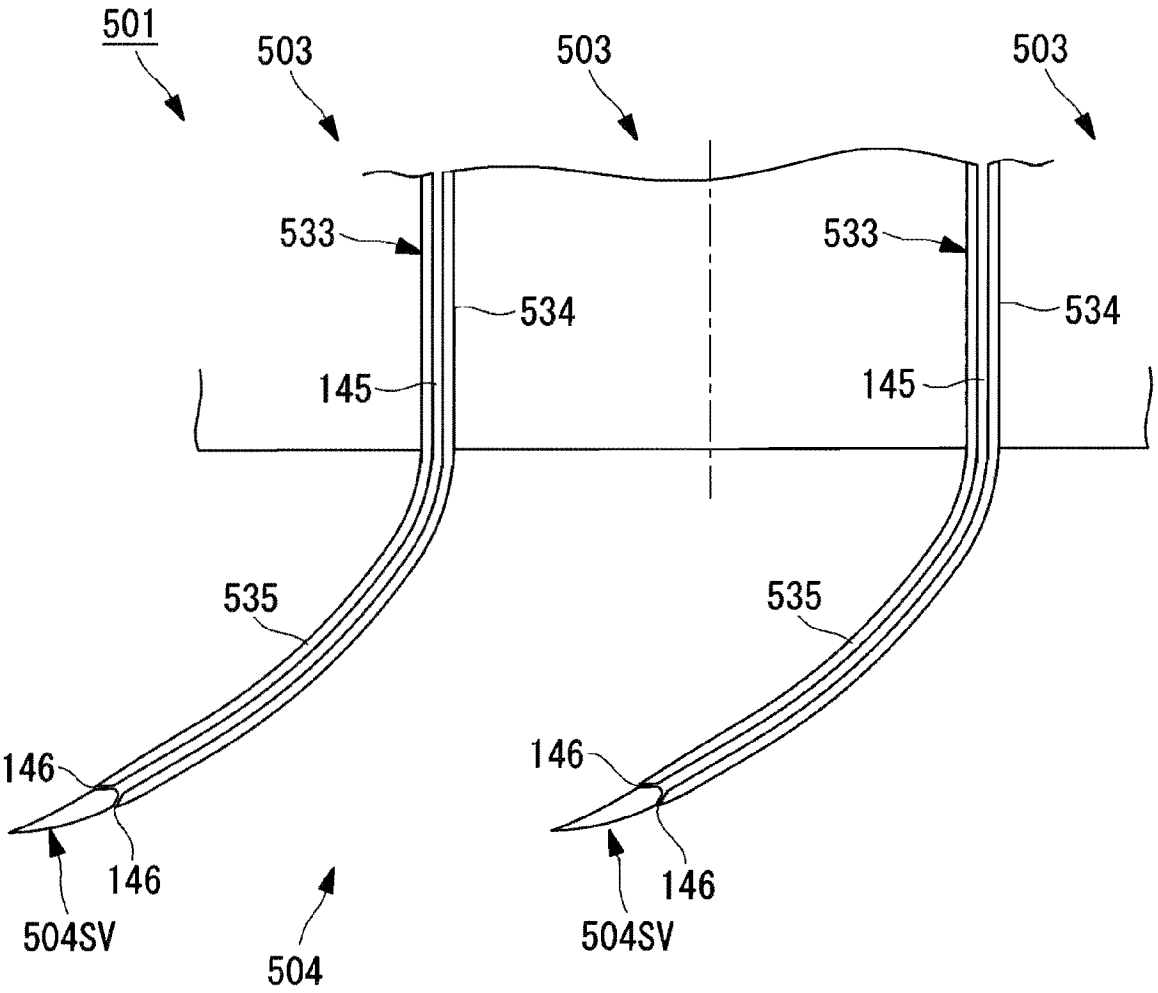
FIG. 9 is a partially enlarged view for explaining a communicating structure between a combustor and a turbine portion in a gas turbine according to a sixth embodiment of the present invention.

FIG. 9 is a partially enlarged view for explaining the communicating structure between the combustors and the turbine portion in the gas turbine according to this embodiment.

Note that components that are the same as those in the first embodiment are given the same reference signs, and descriptions thereof will be omitted.

As shown in FIG. 9, combustors 503 in a gas turbine 501 of this embodiment differ from those in the first embodiment in the shapes of the end portions (bottom-side end portions in FIG. 9) of sidewalls 534 of tail pipes (pipe pieces) 533 closer to a turbine portion 504.

Specifically, as shown in FIG. 9, the sidewalls 534 of the tail pipes 533 in the combustors 503 are provided with tilted portions 535 that deflect the flow of combustion gas leftward in FIG. 9.

The tilted portions 535 are end portions of the sidewalls 534 closer to the turbine portion 504 and are portions adjacent to the first-stage turbine stator vanes 504SV. Furthermore, because the tilted portions 535 are formed by tilting the sidewalls 534 without other modifications, the thickness-wise size of the tilted portions 535 and the thickness-wise size of parts of the sidewalls 534 other than the tilted portions 535 are the same.

Furthermore, upstream-side end portions (top-side end portions in FIG. 9) of the tilted portions 535 with respect to the flow of combustion gas are at positions equivalent to the leading edges LE of the first-stage turbine stator vanes 304SV in the fourth embodiment.

As shown in FIG. 9, the cooling channels 145 inside which cooling fluid, such as the cooling air, flows and that extend in the direction (top-bottom direction in FIG. 9) in which the combustion gas flows are provided between adjacent tail pipes 533. Furthermore, the cooling channels 145 extend along the tilted portions 535, between the tilted portions 535 at the sidewalls 534.

End portions of the cooling channels 145 open at downstream-side end portions (bottom-side end portions in FIG. 9) of the tilted portions 535 at the sidewalls 534.

On the other hand, as shown in FIG. 9, the turbine portion 504 of the gas turbine 501 in this embodiment is provided with the first-stage turbine stator vanes (turbine stator vanes) 504SV.

The first-stage turbine stator vanes 504SV form a turbine stage together with the first-stage turbine rotor blades 4RB and generate a rotational driving force together with the first-stage rotor blades 4RB from the combustion gas that has flowed into the turbine portion 504. Furthermore, the first-stage turbine stator vanes 504SV are a plurality of blades that are arranged at equal intervals on the same circumference around the rotating shaft 5 and that are also arranged so as to extend along the radial direction (vertical direction in FIG. 9 with respect to the plane of the drawing).

The first-stage turbine stator vanes 504SV are disposed at positions facing the downstream-side end portions (bottom-side end portions in FIG. 9) of the tilted portions 535 with respect to the flow of combustion gas.

The first-stage turbine stator vanes 504SV are formed with a smaller sectional area as compared with the first-stage turbine stator vanes 4SV, and a portion in the first-stage turbine stator vanes 504SV where the thickness-wise size is the largest has the same thickness-wise size as the tilted portions 535.

Furthermore, trailing edges TE of the first-stage turbine stator vanes 504SV are disposed at the same positions as the trailing edges TE of the first-stage turbine stator vanes 4SV in the first embodiment, etc.

Unlike the first-stage turbine stator vanes 4SV in the first embodiment, the cavities 41 inside which the cooling air is supplied and the cooling holes 42 from which the cooling air from the cavities 41 is made to flow out to the peripheries of the first-stage turbine stator vanes 504SV are not formed in the first-stage turbine stator vanes 504SV.

On the other hand, as shown in FIG. 9, outflow channels 146 that communicate with the cooling channels 145 at the tilted portions 535 and from which the cooling air, after flowing through the cooling channels 145, flows out along the peripheries of the first-stage turbine stator vanes 504SV are provided between the first-stage turbine stator vanes 504SV and the tilted portions 535.

The outflow channels 146 are through-holes that extend from the cooling channels 145 toward the outer side of the tilted portions 535 in the downstream direction (left-bottom direction in FIG. 9) of the flow of combustion gas.

Next, the flow of combustion gas from exits of the combustors 503 to the first-stage turbine stator vanes 504SV, which is a feature of this embodiment, will be described.

Note that, because the general operation of the gas turbine 501 is the same as that in the first embodiment, a description thereof will be omitted.

As shown in FIG. 9, the combustion gas flows out from the tail pipes 533 of the combustors 503 and flows into the row of the first-stage turbine stator vanes 504SV at the turbine portion 504.

Specifically, the combustion gas that has flowed along the internal surfaces of the sidewalls 534 of the tail pipes 533 is deflected while flowing along the internal surfaces of the tilted portions 535 at the sidewalls 534 and the external surfaces of first-stage turbine stator vanes 504SV.

At the same time, the cooling air that has flowed through the cooling channels 145 and cooled the tail pipes 533 and the tilted portions 535 flows out along the external surfaces of the first-stage turbine stator vanes 504SV via the outflow channels 146. The cooling air flows along the external surfaces of the first-stage turbine stator vanes 504SV in the form of a film and cools the first-stage turbine stator vanes 504SV.

Note that the technical scope of the present invention is not limited to the above-described embodiments, and various modifications may be added thereto within a range that does not depart from the gist of the present invention.

For example, applications of the present invention are not limited to the above-described embodiments, the present invention may be applied to embodiments in which the above-described embodiments are appropriately combined; it is not particularly limited.

REFERENCE SIGNS LIST

1, 101, 201, 301, 401, 501 gas turbine
2 compressor
3, 103, 203, 303, 403, 503 combustor
4, 104, 204, 304, 404, 504 turbine portion
5 rotating shaft
32 fuel nozzle
33, 133, 233, 433, 533 tail pipe
34, 134, 234, 334 sidewall
4SV, 104SV, 204SV, 304SV 404SV, 504SV fist-stage turbine stator vane (turbine stator vane)
4RB first-stage turbine rotor blade
42 cooling hole
LE leading edge

The invention claimed is:

1. A communicating structure between a plurality of combustors and a turbine portion, wherein the plurality of combustors generate combustion gas by combusting compressed air supplied from a compressor and fuel supplied from fuel nozzles, which are mixed inside a plurality of pipe pieces each of which are provided for each of the combustors and which are disposed next to each other around a rotating shaft, a turbine portion generates a rotational driving force by making the combustion gas sequentially pass through a turbine stage formed of a plurality of turbine stator vanes including first-stage turbine stator vanes and turbine rotor blades disposed around the rotating shaft, wherein at least some of first-stage turbine stator vanes closest to the pipe pieces of the combustors among the turbine stator vanes are disposed downstream of a gap between a sidewall of a first pipe piece of the plurality of pipe pieces and a sidewall of a second pipe piece of the plurality of pipe pieces which is adjacent to the first pipe piece, wherein the distance from leading edges of the first-stage turbine stator vanes disposed downstream of the gap between the sidewalls of the first and second pipe pieces to end portions of the sidewalls closer to the turbine portion is equal to or less than a spacing between an internal surface of the sidewall of the first pipe piece and an internal surface of the sidewall of the second pipe piece in order to prevent the combustion gas from flowing in a gap between the leading edges of the first-stage turbine stator vanes disposed downstream of the gap and the end portions of the side walls closer to the turbine portion, and wherein the internal surfaces of the sidewalls have shapes that are smoothly continuous with combustor-side external surfaces of the first-stage turbine stator vanes disposed downstream of the sidewalls such that the extending directions of the internal surfaces of the sidewalls being the same as the extending directions of the combustor-side external surfaces, the combustor-side external surfaces of the first-stage turbine stator vanes being surfaces which are closest to the internal surfaces of the sidewalls.

2. The communicating structure between combustors and a turbine portion according to claim 1, wherein the first-stage turbine stator vanes having cooling holes, the first-stage turbine stator vanes disposed downstream of the sidewalls has fewer cooling holes than the first-stage turbine stator vanes disposed at locations other than downstream of the sidewalls, the cooling holes are holes from which a cooling fluid to cool the first-stage turbine stator vanes is made to flow out to the peripheries of the first-stage turbine stator vanes.

3. The communicating structure between combustors and a turbine portion according to claim 1, wherein a cooling fluid for cooling the sidewalls is made to flow through a gap between the sidewall of the first pipe piece and the sidewall of the second pipe piece; and the cooling fluid that has cooled the sidewalls subsequently flows along the peripheries of the first-stage turbine stator vanes disposed downstream of the sidewalls from downstream-side end portions of the sidewalls.

4. The communicating structure between a plurality of combustors and a turbine portion, wherein the plurality of combustors generate combustion gas by combusting compressed air supplied from a compressor and fuel supplied from fuel nozzles, which are mixed inside a plurality of pipe pieces each of which are provided for each of the combustors and which are disposed next to each other around a rotating shaft, the turbine portion that generates a rotational driving force by making the combustion gas sequentially pass through a turbine stage formed of a plurality of turbine stator vanes including first-stage turbine stator vanes and turbine rotor blades disposed around the rotating shaft, wherein at least some of the first-stage turbine stator vanes closest to the pipe pieces of the combustors among the turbine stator vanes are disposed downstream of a gap between a sidewall of a first pipe piece of the plurality of pipe pieces and a sidewall of a second pipe piece of the plurality of pipe pieces which is adjacent to the first pipe piece, wherein the distance from leading edges of the first-stage turbine stator vanes disposed downstream of the gap between the sidewalls of the first and second pipe pieces to end portions of the sidewalls closed to the turbine portion is equal to or less than a spacing between an internal surface of the sidewall of the first pipe piece and an internal surface of the sidewall of the second pipe piece in order to prevent the combustion gas from flowing in a gap between the leading edges of the first-stage turbine stator vanes disposed downstream of the gap and the end portions of the side walls closer to the turbine portion, wherein the downstream-side end portions of the sidewalls are tilted in the direction in which the combustion gas is deflected by the first-stage turbine stator vanes, and wherein the internal surfaces of the sidewalls have shapes that are smoothly continuous with combustor-side external surfaces of the first-stage turbine stator vanes disposed downstream of the sidewalls such that the extending directions of the internal surfaces of the sidewalls being the same as the extending directions of the combustor-side external surfaces, the combustor-side external surfaces of the first-stage turbine stator vanes being surfaces which are closest to the internal surfaces of the sidewalls.

5. The communicating structure between combustors and a turbine portion according claim 4, wherein said sidewalls which are tilted, in cross-sectional view, form airfoil shapes together with the first-stage turbine stator vanes disposed downstream of the sidewalls.

6. A gas turbine comprising:

a compressor that compresses air;

a combustor that generates combustion gas by combusting compressed air supplied from the compressor and fuel supplied from a fuel nozzle, which are mixed therein;

a turbine portion that converts part of energy possessed by the combustion gas into a rotational driving force;

a rotating shaft that transmits the rotational driving force from the turbine portion to the compressor; and the communicating structure between the combustors and the turbine portion according to claim 1.

* * * * *